US005788897A

United States Patent [19]

Hsu

[11] Patent Number: 5,788,897

[45] Date of Patent: Aug. 4, 1998

[54] ELECTRICALLY CONDUCTIVE FIBERS

[75] Inventor: Che-Hsiung Hsu, Wilmington, Del.

[73] Assignee: E. I. Du Pont de Nemours and Company, Wilmington, Del.

[21] Appl. No.: 760,180

[22] Filed: Sep. 13, 1991

Related U.S. Application Data

[63] Continuation-in-part of Ser. No. 227,785, Aug. 3, 1988, abandoned.

[51] Int. Cl.[6] ..... D01H 6/00

[52] U.S. Cl. ..... 264/184; 264/205

[58] Field of Search ..... 428/364, 375, 428/394, 395; 429/213; 252/500, 518; 264/184, 205

[56] References Cited

U.S. PATENT DOCUMENTS

| | | | |
|---|---|---|---|
| 4,025,463 | 5/1977 | Trevoy | 252/501.1 |
| 4,025,691 | 5/1977 | Trevoy | 428/411 |
| 4,025,704 | 5/1977 | Trevoy | 252/501.1 |
| 4,237,194 | 12/1980 | Upson et al. | 228/424.2 |
| 4,526,706 | 7/1985 | Upson et al. | 430/62 |
| 4,699,804 | 10/1987 | Miyata et al. | 427/108 |
| 4,803,096 | 2/1989 | Kuhn | 427/121 |
| 4,855,361 | 8/1989 | Yaniger et al. | 525/436 |
| 4,904,553 | 2/1990 | Nakajima et al. | 427/213 |
| 5,069,820 | 12/1991 | Jen et al. | 252/500 |
| 5,109,070 | 4/1992 | Epstein et al. | 525/189 |
| 5,135,682 | 8/1992 | Cohen et al. | 252/518 |
| 5,160,457 | 11/1992 | Elsenbaumer et al. | 252/519 |
| 5,164,465 | 11/1992 | Epstein et al. | 252/500 |
| 5,171,478 | 12/1992 | Han | 252/518 |
| 5,177,187 | 1/1993 | MacDiarmid et al. | 252/500 |
| 5,196,144 | 3/1993 | Smith et al. | 252/500 |

FOREIGN PATENT DOCUMENTS

WO9105979 5/1991 WIPO .

*Primary Examiner*—Marion E. McCamish
*Assistant Examiner*—J. M. Gray

[57] ABSTRACT

High strength poly(p-phenylene terephthalamide) fibers are rendered electrically conductive with sulfonic acid ring-substituted polyaniline.

1 Claim, 1 Drawing Sheet

FIGURE
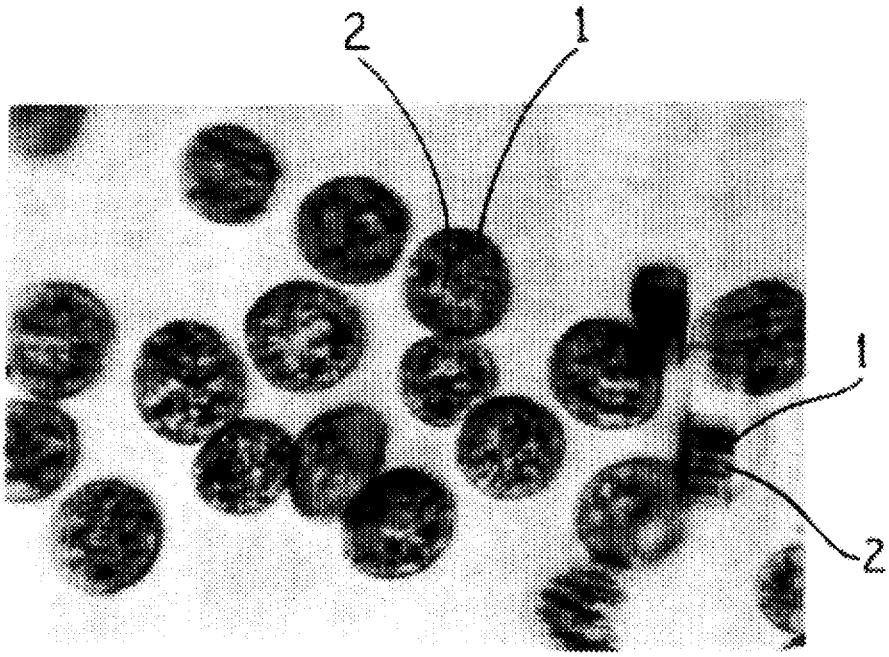

ELECTRICALLY CONDUCTIVE FIBERS

RELATED APPLICATIONS

This application is a continuation-in-part of U.S. application Ser. No. 07/227,785 filed Aug. 3, 1988 now abandoned.

BACKGROUND OF THE INVENTION

Sulfonic acid ring—substituted polyaniline is a "self-doped" conducting polymer, reported by Yue, Epstein and Mac Diarmid in Proc. Symposium on Electroresponsive Molecular and Polymeric Systems, Brookhaven National Laboratory, October 1989, to have a conductivity of ~0.03 S/cm. without external doping. Synthesis of the material is also described in J. A. C. S. 1991, V.113, N.7 pp. 2665–2671 which shows a conductivity of ~0.1 S/cm measured on pressed pellets.

Fibers of a blend of polyaniline and poly(p-phenylene terephthalamide) prepared from homogeneous solutions in concentrated sulfuric acid are described in Polymer Commun 31,275 (1990). The fibers are said to have improved mechanical properties while retaining the conductivity of pure polyaniline. The concentration of poly(p - phenylene terephthalamide) in the spinning solution employed by the experimentors was below the onset of formation of lyotropic phase, thus, the fibers were spun from isotropic solutions.

FIGURES

FIG. 1 is photomicrograph of transverse and longitudinal cross-sections of fibers of the invention at 1200×.

SUMMARY OF THE INVENTION

The present invention provides a high strength, high modulus, electrically conductive fiber consisting essentially of poly (p-phenylene terephthalamide) and a sulfonic acid ring-substituted polyaniline in an amount to render the fiber electrically conductive, said fiber having an as-spun tenacity of at least 10 grams per denier and a sulfur content of at least 9% by weight based on the weight of the sulfonated polyaniline. Preferably, the ratio of sulfonated polyaniline to poly(p-phenylene terephthalamide) in the fiber is from 10/90 to 30/70 on a weight percent basis.

Also encompassed by the present invention is a process for preparing the novel fiber which comprises forming a lyotropic solution of sulfonated polyaniline and poly (p-phenylene terephthalamide) in concentrated sulfuric acid (>100%) the ratio of sulfonated polyaniline to poly (pphenylene terephthalamide) being from 10/90 to 30/70 on a weight % basis and the solution containing at least 15% by weight of total polymer content and extruding the solution through an air gap into a coagulating bath to form the fiber.

DETAILED DESCRIPTION OF THE INVENTION

The spin dope employed in the process of the invention may be prepared by combining the polyaniline with a solution of poly (p-phenylene terephthalamide) (PPD-T) in concentrated sulfuric acid (>100%) at temperatures in excess of 45° C. Sulfonation of the polyaniline occurs under such conditions, with more rapid reaction taking place with increased temperature, sulfuric acid concentration and time. The particular method employed for sulfonation of the polyaniline is not critical. Methods of sulfonation are disclosed in the references mentioned in the "Background" section. The sulfur content of the sulfonated polyaniline should be at least 9% by wt. for high conductivity. The molecular weight of the polyaniline employed in the invention is not critical. Low molecular weights result in lower solution viscosity and easier processing, however, it might be more readily removed from the fiber in processing or use. The PPD-T is used in its high molecular form, having an inherent viscosity of at least 5. In order to obtain the desirable high strength, a concentration of PPD-T is employed that provides a lyotropic solution as discussed in U.S. Pat. No. 3,767,756. Spin solutions containing at least 15% by wt. of total polymer content, i.e., sulfonated polyaniline plus PPD-T, meet this requirement.

The ratio of sulfonated polyaniline to PPD-T in the spin solution and ultimately in the spun fiber has an important influence on fiber properties. As the content of sulfonated polyaniline exceeds 30 wt% of the polymer mixture, the tensile strength of the composite fiber becomes undesirably reduced with no concomitant increase in electrical conductivity. The sulfonated polyaniline should constitute at least 10 wt% of the polymer mixture to provide electrical conductivity of at least about 0.03 S/cm. Preferably the sulfonated polyaniline should constitute from 20 to 30 wt% based on the polymer mixture. surprisingly, fibers of the invention composed of this mixture exhibit a level of electrical conductivity far in excess of that of 100% sulfonated polyaniline. It is believed that the spinning process of this invention enhances the conductivity.

The fibers of the invention have good strength, an as-spun tenacity above 10 gpd, and a reasonable level of conductivity. By "as-spun" is meant that the fibers formed in the spinning step following take-up, have not been subjected to a drawing or heat-treating operation which changes the molecular order or arrangement of the polymer molecules. Washing and drying operations needed to remove solvents or impurities are permitted. The conductivity of the fiber of the invention remains stable under conditions of use and the fiber requires no doping.

The sulfonated polyaniline is dispersed within the fiber as elongated amorphous structures aligned with the fiber axis. This may explain the high conductivity even at low levels of sulfonated polyaniline in the composite fiber.

Test Methods Electrical conductivity:

Electrical resistance of fiber at ambient condition is determined by a four probe method for calculation of electrical conductivity. Fiber specimen to be tested is about 1.5 cm long. Room temperature curing silver paste is used for making four electrodes on fiber specimen. The two inner voltage measuring electrodes are about 8 mm apart. Electrical current is applied to the two outer electrodes and the voltage corresponding to the known current is determined with an electrometer. Resistance is calculated based on Ohm's law. Conductivity in S/cm is calculated by normalization based on fiber cross-section and the distance between the voltage electrodes. S corresponds to Siemen.

Tensile Test:

Tenacity/Elongation/Modulus (T/E/Mi) of single filaments at 1" gauge length are reported in grams per denier for T and Mi and in % for E. The tensile test is determined according to ASTM 2101. Filament denier is determined according to ASTM D1577 using a vibroscope.

Sulfur Element Analysis:

Fiber sample is first combusted with oxygen in a flask. The generated $SO_2$ and $SO_3$ gases are absorbed in water. Hydrogen peroxide is added to insure that all sulfur is converted to sulfate. After boiling with platinum black to remove any excess $H_2$ 2, the pH is adjusted. The solution is then added with isopropanol in a 50/50 in ratio to water. The solution is then titrated with a standardized $BaCl_2$ solution for determination of sulfate concentration. The amount of sulfur is determined based on the sulfate concentration.

The following examples are illustrative of the invention and are not intended as limiting.

EXAMPLE 1

This example illustrates air-gap spinning of polyaniline/poly(p-phenylene terephthalamide) solutions of high polymer concentration to form conductive fibers.

Polyaniline was prepared according to the following method. A solution consisting of 134.3 g aniline, 194.4 g 37 wt % HCl solution and 1,350 g deionized water were placed in a two liter jacketed glass reaction vessel under a nitrogen atmosphere. The solution was stirred continuously using a 3 inch diameter twin-blade impeller. A coolant, supplied by a chilling unit, was circulated through the reaction vessel jacket to cool the aniline/HCl solution to −3° C. An oxidant solution consisting of 155 g ammonium persulfate in 270 g water was added to the reaction vessel at a rate of 1.95 ml/min using a syringe pump. Following the addition of the oxidant solution, the reaction mixture was stirred at about −3° C. for 3.5 days. The reactor contents were then filtered and the collected powder was washed by repetitively slurrying in water and filtering, followed by vacuum-drying prior to being neutralized by re-slurrying the powder in 0.15 M ammonium hydroxide solution twice for 24 hours each time. The neutralized polymer was then dried before being washed twice with 1.5 liters of methanol followed by a final wash with acetone. The polymer was dried and stored in a dry box until use. The polymer has an inherent viscosity of 1.29 measured at 30° C. as a 0.5 wt. % solution in $H_2SO_4$ (96.7% conc.) and is not electrically conductive because neutralization with ammonium hydroxide converts the polyaniline from the conductive form (emeraldine salt) to the insulating base form.

A 17 wt % polyaniline/$H_2SO_4$ solution was prepared by adding 10.2 g of the polyaniline (base form) prepared as described above to 49.8 g $H_2SO_4$ (100.15%) which was in a nitrogen-purged glove bag and had been chilled in a pre-dried glass bottle using a dry ice/acetone bath located outside the glove bag. The mixture was stirred vigorously with a spatula while being chilled with the dry ice/acetone bath. The mixture was then transferred to a pre-dried twin cell having a cross-over plate for mixing (see Blades U.S. Pat. No. 3,767,756). The mixture was pushed back and forth through the cross-over plate for 2 hrs at approximately 45° C. to obtain a homogeneous solution. The solution in the twin cell was transferred to three pre-dried glass bottles in amounts of 3.32, 7.83, and 9.3 g. The polyaniline solutions were mixed with poly(p-phenylene terephthalamide) (PPD-T) and concentrated sulfuric acid (>100%) to prepare 18.6 wt % spin dope solutions having weight ratios of polyaniline:PPD-T of 10:90, 20:80, and 30:70. For example, the 10:90 solution was prepared by mixing 3.32 g of the 17 wt % polyaniline solution with 0.81 g $H_2SO_4$ (100.15 wt %) and 26.19 g of a 19.4 wt % solution of poly(p-phenylene terephthalamide) in $H_2SO_4$ (>100%) at room temperature under nitrogen. The mixture was then stirred at about 65° C. for 30 min and transferred to a 1 inch diameter twin cell where it was kept at 70° C. for 30 minutes and further mixed at 65° C. for 30 minutes by passing the mixture through a cross-over plate between cells to ensure homogeneity. The same procedure was used, adjusting the amounts of poly (pphenylene terephthalamide) solution and polyaniline solution, to prepare spin dopes having polyaniline:PPD-T ratios of 20:80 and 30:70.

The spin dopes containing 18.6 wt % polymer were spun through an air gap according to the following procedure. The spin dope solutions prepared above were transferred to one side of the twin cell and a filtration pack consisting of 200 and 325 mesh stainless steel screens and a dynalloy disc was inserted between the twin cell and a single-hole spinneret having a diameter of 3 mil and a length of 9 mil. The spinneret was located 0.25 inch above a one gallon glass container of ice-chilled deionized water. A threadline guide was placed 3 inches below the spinneret in the deionized water. The threadline traveled an additional 8 inches in the water before being wound up on a bobbin which was partially immersed in a deionized water containing tray. The extrusion pressure in pounds per square inch (psi), spinneret temperature (same as spinning cell) and fiber wind-up speeds for the samples spun from the three polyaniline/PPD-T solutions are summarized in Table 1. The continuous filament on each bobbin, typically weighing less than 0.3 g, was immersed in 900 ml deionized water for one day immediately after the spinning. The water was changed three times with fresh deionized water during that period. The filament samples were then dried and denier(D)/tenacity(T)/elongation(E)/modulus(M), electrical conductivity and sulfur elemental analysis were measured. The results in Table 1 show that the fibers are electrically conductive after extensive washing with deionized water. This was unexpected because doped polyaniline typically loses conductivity when contacted with aqueous solutions having a pH greater than about 4. The fiber samples all contain sulfur which may be attributed to covalently bound sulfonic acid groups in the polyaniline at positions ortho to the imide groups. Due to the processing in concentrated $H_2SO_4$ (>100%) at elevated temperatures, sulfonation of the polyaniline occurred in situ. The sulfonic acid groups function as internal dopants to render the polyaniline polymer conductive. This hypothesis is supported by the fact that the sulfur is not readily removed as illustrated in Table 1 for samples 10 and 12. These two samples were immersed in 900 ml 0.1 M ammonium hydroxide for 4 hrs. The ammonium hydroxide-treated fibers were then washed extensively with deionized-water. After the neutralization and water washing, the two fiber samples contained 3.24 and 3.21 wt % sulfur. Since the sulfur is not removed by neutralization is evidence that it exists as sulfonated acid groups covalently bound to the polyaniline.

TABLE 1

| Composition** (Sulfonated Polyaniline/ PPD-T) | Spinneret Temp (°C.) | Extrusion Pressure (psi) | Wind-Up Speed (ft/min) | D/T/E/M den/gpd/%/gpd | Cond. (S/cm) | Sulfur (wt %)[1] | Sulfur (wt %)[2] |
|---|---|---|---|---|---|---|---|
| 1) 10\90 | 70 | 300 | 135 | — | 0.07 | 1.6 | 11.8 |
| 2) 10\90 | 70 | 300 | 175 | 1.8/17.6/4.4/402 | — | — | — |
| 3) 10\90 | 80 | 300 | 200 | 2.1/15.9/4.7/329 | — | — | — |
| 4) 10\90 | 80 | 300 | 200 | — | 0.03 | 1.7 | 12.3 |
| 5) 20\80 | 70 | 280 | 200 | — | 1.6 | 2.33 | 9.4 |

TABLE 1-continued

| Composition** (Sulfonated Polyaniline/ PPD-T) | Spinneret Temp (°C.) | Extrusion Pressure (psi) | Wind-Up Speed (ft/min) | D/T/E/M den/gpd/%/gpd | Cond. (S/cm) | Sulfur (wt %)[1] | Sulfur (wt %)[2] |
|---|---|---|---|---|---|---|---|
| 6) 20\80 | 70 | 280 | 200 | 1.5/12.9/3.6/373 | — | — | — |
| 7) 20\80 | 80 | 250 | 200 | — | 0.97 | 2.39 | 9.6 |
| 8) 20\80 | 80 | 250 | 200 | 1.8/12.5/4.1/324 | — | — | — |
| 9) 30\70 | 70 | 300 | 200 | 1.6/11.6/3.4/387 | — | — | — |
| 10) 30\70 | 70 | 300 | 200 | — | 1.7 | — | — |
| 30\70 | 70 | 300 | 200 | — | — | 3.24* | 9.1 |
| 11) 30\70 | 80 | 250 | 200 | 1.6/13.7/4.0/364 | — | — | — |
| 12) 30\70 | 80 | 250 | 200 | — | 1.8 | — | — |
| 30\70 | 80 | 250 | 200 | — | — | 3.21* | 9.0 |

*Immersed in 900 ml of 0.1 M ammonium hydroxide solution for 4 hrs followed by extensive deionized-water washing.
**Based on polyaniline and PPD-T content.
[1]Percentage based on total fiber weight (Measured)
[2]Calculated percentage based only on sulfonated polyaniline.

EXAMPLE 2

This example illustrates air-gap spinning of a 15.2 wt % polymer solution in $H_2SO_4$ containing sulfonated polyaniline/PPD-T in a weight ratio of 30/70. A 10 wt % polyaniline/$H_2SO_4$ solution was prepared by mixing 8 g of the polyaniline prepared in Example 1 with 72 g $H_2SO_4$ (100.15%) while cooling with a dry ice/acetone mixture in a dry nitrogen atmosphere. The mixture was then transferred to a twin cell under nitrogen and mixed further at room temperature for two hours to obtain a homogeneous solution. A 15.2 wt % spin dope was prepared by mixing 22.66 g of the 10 wt % polyaniline solution with 27.30 g PPD-T/$H_2SO_4$(>100%) at 65° C. in a twin cell under a dry nitrogen atmosphere. The mixture was further mixed at 65° C. for one hour to obtain a homogeneous solution. The solution was then spun at 80° C., 340 psi extrusion pressure and 195 feet/min wind-up speed using the procedure described in Example 1. After washing with deionized water, as described in Example 1, the filament has D/T/E/M of 2.0/7.9/4.1/265 and electrical conductivity of 0.09 S/cm. Comparing with samples 11 and 12 in Table 1, these results show that the 15.2 wt % polyaniline/PPD-T solution yields fiber having lower tensile strength, modulus and electrical conductivity than the 18.6 wt % solution.

EXAMPLE 3

(Comparative Example)

This example illustrates air-gap spinning of a 13.2 wt % polymer solution in $H_2SO_4$ containing sulfonated polyaniline/PPD-T in a weight ratio of 30/70.

A spin dope was prepared by mixing 5.91 g $H_2SO_4$ (100.15% concentration), 21.91 g PPD-T/$H_2SO_4$ (>100%), and 18.16 g of the 10.0 wt % polyaniline/$H_2SO_4$ solution prepared in Example 2 in a twin cell at room temperature for two hours. The twin cell was then heated to 45° C. for additional mixing for one hour to obtain a homogeneous 13.2 wt % polyaniline/PPD-T (30/70) solution. The solution was spun into a continuous filament at 70° C., 400 psi extrusion pressure, and 195 feet/min wind-up speed according to the procedure described in Example 1. After washing with deionized water, as described in Example 1, the filament has D/T/E/M of 3.4/5.5/4.7/206 and electrical conductivity of 0.03 S/cm. Comparing with samples 9 and 10 in Table 1, these results show that the 13.2 wt % polyaniline/PPD-T (30/70) solution yields fiber having lower tensile strength, tensile modulus, and electrical conductivity than the 18.6 wt % solution.

EXAMPLE 4

This example illustrates air-gap spinning of sulfonated polyaniline/PPD-T solutions containing 18.6 wt % polymer to form conductive fibers.

Spinning solutions containing 18.6 wt % polymer in concentrated $H_2SO_4$ and having polyaniline/PPD-T ratios of 10/90, 20/80, 30/70 and 40/60 were prepared according to the following procedure. PPD-T (19.4 wt % in $H_2SO_4$), polyaniline polymer (base form) prepared in Example 1, and sulfuric acid (100.15 wt %) were placed in a pre-dried glass bottle in amounts required to form solutions containing 18.6 wt % polymer and the desired polyaniline/PPD-T ratio. The bottle was then placed in a nitrogen-purged oven at 70° C. for one hour, after which the mixture was stirred before transferring to a hot (70° C.) twin cell. The twin cell was heated in the nitrogen-purged oven at 70° C. for one hour, after which the mixture was mixed through a cross-over plate for 1.5 hrs to obtain a homogeneous solution.

The polyaniline/PPD-T solutions were spun using the procedure described in Example 1. The extrusion pressure, spinneret temperature, and wind-up speed for the individual spinning runs are summarized in Table 2.

Immediately after spinning, the bobbins containing the continuous filaments (approximately 0.3 g fiber each) were immersed in 900 ml deionized water for one day. The water was changed three times with fresh deionized water during that time. D/T/E/M, and electrical conductivity of the water-washed fibers are summarized in Table 2. Although the fibers were washed extensively with deionized water, they remained electrically conductive. The results in Table 2 also demonstrate that tensile strength and modulus decrease as the polyaniline/PPD-T ratio increases. The preferred ratio is 30/70 since the fibers have the highest conductivity and yet still have high strength and modulus.

X-ray photographs taken of fibers of each composition show that sulfonated polyaniline exists as amorphous polymer whereas PPD-T polymer chains are highly oriented with orientation angles in the range of 13.6 to 14.8. Optical photographs (FIG. 1) of Item 1 of Table 2 show that PPD-T and sulfonated polyaniline are segregated. Sulfonated polyaniline (1) is shown dispersed homogeneously in a matrix of PPD-T (2) in the transverse cross-section and as elongated striations aligned along the fiber axis, in the longitudinal cross-section. This may explain the high conductivity even at the 10/90 ratio.

TABLE 2

| Composition (Sulfonated Polyaniline/ PPD-T)[1] | Spinneret Temp (°C.) | Extrusion Pressure (psi) | Wind-Up Speed (ft/min) | D/T/E/M den/gpd/%/gpd | Cond. (S/cm) | Sulfur (wt %)[2] | Sulfur (wt %)[3] |
|---|---|---|---|---|---|---|---|
| 1) 10\90 | 80 | 250 | 200 | 2.0/14.2/4.4/353 | — | — | — |
| 2) 10\90 | 80 | 250 | 200 | — | 0.03 | — | — |
| 10\90 | 80 | 250 | 200 | — | 0.07* | 1.82* | 12.9 |
| 3) 20\80 | 75 | 260 | 200 | 1.3/13.8/3.9/418 | — | — | — |
| 4) 20\80 | 75 | 260 | 200 | — | 0.8 | — | — |
| 5) 20\80 | 80 | 260 | 200 | 1.6/13.6/4.4/346 | — | — | — |
| 6) 20\80 | 80 | 260 | 200 | — | 0.4 | — | — |
| 7) 30\70 | 75 | 280 | 200 | 1.2/11.4/3.4/372 | — | — | — |
| 8) 30\70 | 75 | 280 | 200 | — | 1.5 | — | — |
| 9) 30\70 | 80 | 280 | 200 | 0.9/10.6/3.2/370 | — | — | — |
| 10) 30\70 | 80 | 280 | 200 | — | 0.6 | 4.14 | 11.1 |
| 30\70 | 80 | 280 | 200 | — | 0.3** | 4.14** | 11.1 |
| 11) 40\60 | 75 | 350 | 200 | — | 1 | — | — |
| 12) 40\60 | 75 | 350 | 200 | 1.9/10.4/3.4/330 | — | — | — |
| 13) 40\60 | 80 | 350 | 200 | 2.3/9.7/3.6/293 | — | — | — |
| 14) 40\60 | 80 | 350 | 200 | — | 0.4 | 4.41 | 9.5 |
| 40\60 | 80 | 350 | 200 | — | 0.04*** | 1.67*** | 3.9 |

*Immersed in 900 ml of 0.1 M ammonium hydroxide solution for 3 hrs and in another fresh 990 ml solution for 4 hrs followed by extensive deionized water washing.
**Same as * except 2 hrs and 6 hrs in the first and second solutions, respectively.
***Same as * except 2 hrs and 4 hrs in the first and second solutions, respectively.
[1]Based on polyaniline and PPD-T content.
[2]Measured percentage based on total fiber weight.
[3]Calculated percentage based only on sulfonated polyaniline.

EXAMPLE 5

This example illustrates the effect of neutralization with ammonium hydroxide on the conductivity of Sample 2 of Example 4(polyaniline/PPD-T=10/90).

The conductivity of a section of the fiber of Sample 2 (Example 4) which had been washed extensively with deionized water was measured and found to have a conductivity of 0.03 S/cm. Another sample of the fiber without drying was immersed in 900 ml 0.1 M ammonium hydroxide solution for 3 hr and in another fresh 900 ml 0.1 M ammonium hydroxide solution for 4 hr. Both ammonium hydroxide solutions were colorless at the end of each immersion. However, the color of the fiber changed from green (conductive form) to blue (insulating form) upon contact with the solution since ammonium hydroxide neutralizes the acid in the fiber. The neutralized fiber was then washed in running deionized water for 6 hr, after which the fiber had reverted back to its original green color. The fiber contained 1.82 wt % sulfur and had a conductivity of 0.07 S/cm. This result shows that the conductivity is not affected by the neutralization with ammonium hydroxide providing evidence that the sulfur exists as sulfonic acid groups covalently bound to polyaniline.

EXAMPLE 6

This example illustrates the effect of neutralization with ammonium hydroxide on the conductivity of Sample 10 of Example 4 (polyaniline/PPD-T=30/70 (wt/wt)).

A section of the fiber of Sample 10 (Example 4) which had been washed extensively with deionized water had a sulfur content of 4.14 wt % and a conductivity of 0.6 S/cm. The remaining section of undried fiber was immersed in 900 ml 0.1 M ammonium hydroxide solution for 2 hrs and in another 900 ml fresh 0.1 M ammonium hydroxide solution for 6 hrs. The ammonium hydroxide solutions were slightly purple in color following each immersion. The neutralized fiber was then washed in running deionized water for 16 hr, after which it still had a sulfur content of 4.14 wt % and a conductivity of 0.3 S/cm. This example as well as Example 5 illustrate that the polyaniline in the fibers is sulfonated and that the sulfonic acid groups are not readily extracted with basic solutions.

EXAMPLE 7

(Comparative Example)

A section of the fiber of Sample 14 (Example 4) which had been washed extensively with deionized water had a sulfur content of 4.41 wt % and a conductivity of 0.4 S/cm. The remaining section of undried fiber was immersed in 900 ml 0.1 M ammonium hydroxide solution for 2 hrs and in another 900 ml fresh 0.1 M ammonium hydroxide solution for 4 hrs. The ammonium hydroxide solutions were dark purple following each immersion. Evidently, some of the polyaniline in the fiber was extracted into the ammonium hydroxide solutions. The neutralized fiber was washed extensively in running deionized water for 13 hrs. The treated fiber had a sulfur content of 1.67 wt %, significantly lower than the sulfur content in the untreated fiber. The conductivity decreased from 0.4 S/cm to 0.04 S/cm. This example suggests that a portion of the sulfonated polyaniline is extractable at polyaniline/PPD-T ratios significantly greater than 30/70.

I claim:

1. A method for preparing a high modulus electrically conductive fiber having an as-spun tenacity of at least 10 grams per denier and consisting essentially of poly(p-phenylene terephthalamide) and a sulfonic acid ring-substituted polyaniline comprising a) forming a solution of sulfonated polyaniline having a sulfur content of at least 9% by weight and poly(p-phenylene terephthalamide) in concentrated sulfuric acid, the ratio of sulfonated polyaniline to poly(p-phenylene terephthalamide) being from 10/90 to 30/70 on a weight % basis, and the solution containing at least 15 wt. % of total polymer content, and b) extruding the solution through an air gap into a coagulating bath to form the fiber.

* * * * *